US009061201B2

(12) United States Patent
Kyrychenko

(10) Patent No.: US 9,061,201 B2
(45) Date of Patent: Jun. 23, 2015

(54) APPARATUS FOR HANDLING PLAYING CARDS AND METHOD OF USE

(76) Inventor: Olexandr Ivanovich Kyrychenko, Newcastle (GB)

( * ) Notice: Subject to any disclaimer, the term of this patent is extended or adjusted under 35 U.S.C. 154(b) by 93 days.

(21) Appl. No.: 13/988,907

(22) PCT Filed: Nov. 30, 2011

(86) PCT No.: PCT/GB2011/001664
§ 371 (c)(1),
(2), (4) Date: Jul. 22, 2013

(87) PCT Pub. No.: WO2012/072979
PCT Pub. Date: Jun. 7, 2012

(65) Prior Publication Data

US 2013/0300060 A1 Nov. 14, 2013

(30) Foreign Application Priority Data

Dec. 3, 2010 (GB) ..... 1020471.7

(51) Int. Cl.
*A63F 1/14* (2006.01)
*A63F 1/12* (2006.01)

(52) U.S. Cl.
CPC .... *A63F 1/14* (2013.01); *A63F 1/12* (2013.01)

(58) Field of Classification Search
CPC ..... A63F 1/12; A63F 1/14
USPC ..... 273/149
See application file for complete search history.

(56) References Cited

U.S. PATENT DOCUMENTS 1,545,650 A * 7/1925 Frank ..... 273/150
3,841,637 A * 10/1974 Piazza et al. ..... 273/141 A (Continued)

FOREIGN PATENT DOCUMENTS

CN 201454028 U 5/2010

OTHER PUBLICATIONS

Search Report dated Mar. 15, 2012 issued in corresponding United Kingdom Patent Application No. GB1120591.1.

(Continued)

*Primary Examiner* — Michael Dennis
*Assistant Examiner* — Dolores Collins
(74) *Attorney, Agent, or Firm* — Pearne & Gordon LLP

(57) ABSTRACT

An apparatus (100) for a card game using physical playing cards (7), the apparatus comprising first and second card storage arrangements each comprising a respective generally cylindrical drum (1*a*), (1*b*) for storing a plurality of (cards 7), each arrangement having a plurality of card receiving spaces 6*a*, (6*b*), each card receiving space (6*a*), (6*b*) being arranged to store a respective single card (7). A card feeding arrangement is included which comprises a channel 4 extending between the drums (1*a*), (1*b*), for consecutively transferring cards (7) by gravity from a selected card receiving space (6*a*), (6*b*) in one of the first and second arrangements to a selected card receiving space (6*a*), (6*b*) in the other of the first and second arrangements via a card playing area wherein. The apparatus is selectably moveable between a first condition with the first drum 1 *a* located at a higher position than the second drum (1*b*) with the cards being transferable downwardly from the first drum 1*a* to the second drum (1*b*), and a second condition with the second drum (1*b*) located at a higher position than the first drum (1*a*), in which the cards are transferable downwardly from the second drum (1*b*) to the first drum (1*a*).

15 Claims, 5 Drawing Sheets

(56) References Cited

U.S. PATENT DOCUMENTS

| | | | | |
|---|---|---|---|---|
| 4,369,972 | A * | 1/1983 | Parker | 273/148 A |
| 4,667,959 | A * | 5/1987 | Pfeiffer et al. | 273/149 R |
| 5,775,993 | A * | 7/1998 | Fentz et al. | 463/17 |
| 6,890,255 | B2 * | 5/2005 | Jarvis et al. | 463/17 |
| 7,500,672 | B2 * | 3/2009 | Ho | 273/149 R |
| 7,523,935 | B2 * | 4/2009 | Grauzer et al. | 273/149 R |
| 7,753,374 | B2 * | 7/2010 | Ho | 273/149 R |
| 8,505,919 | B2 * | 8/2013 | Jones | 273/292 |
| D696,355 | S * | 12/2013 | MacDonald et al. | D21/375 |
| 8,727,694 | B2 * | 5/2014 | Hiyama et al. | 414/793.8 |
| 2003/0047870 | A1 | 3/2003 | Blaha et al. | |
| 2007/0298865 | A1 | 12/2007 | Soltys | |
| 2008/0303210 | A1 * | 12/2008 | Grauzer et al. | 273/149 R |
| 2009/0189346 | A1 | 7/2009 | Krenn et al. | |
| 2009/0302535 | A1 * | 12/2009 | Ho | 273/149 R |
| 2010/0283202 | A1 | 11/2010 | Ho | |
| 2011/0236172 | A1 * | 9/2011 | Hiyama et al. | 414/794.8 |
| 2013/0343856 | A1 * | 12/2013 | Hiyama et al. | 414/794.8 |

OTHER PUBLICATIONS

International Search Report issued in corresponding PCT Patent Application No. PCT/GB2011/001664 on Mar. 19, 2012.

* cited by examiner

APPARATUS FOR HANDLING PLAYING CARDS AND METHOD OF USE

FIELD OF INVENTION

The present invention relates to apparatus for a card game using physical playing cards, and particularly but not exclusively to apparatus in which the players' and dealer's hands are translated into a virtual hand of playing cards and displayed on electronic terminals. The invention also relates to a method of use of an apparatus for a card game.

BACKGROUND

Card games held at tables for instance using physical playing cards dealt by a live dealer are popular in casinos. Examples of such games include Black Jack, Poker or Baccarat. In some instances, the physical cards dealt by a live dealer may be identified by a card reader, and information regarding the cards dealt may be transmitted to one or more terminals which may be remote from the live table. This information may be used for determining the outcome of a game played at the terminal or terminals.

Games involving a live dealer and physical playing cards which may then be translated into virtual cards are generally preferred by players to games using only virtual cards generated by for instance, a random number generator. However, providing such games with physical playing cards poses problems for casinos, including time spent on collecting and shuffling cards, and security measures aimed at providing fair games and tracking down and eliminating various frauds. There is also a significant cost in providing the personnel and equipment required to support such games.

In this specification, the term "card value" is to be understood as representing the rank and/or suit of a playing card.

In this specification the term "card playing area" is to be understood as representing an area where a dealt card is displayed face up and/or face down and can be recognised by technical means and by players.

SUMMARY OF THE INVENTION

According to a first aspect of the present invention, there is provided apparatus for a card game using physical playing cards, the apparatus comprising:

first and second card storage arrangements for storing a plurality of cards, each arrangement having a plurality of card receiving spaces, each card receiving space being arranged to store a respective single card;

a card feeding arrangement for consecutively transferring cards from a selected card receiving space in one of the first and second arrangements to a selected card receiving space in the other of the first and second arrangements via a card playing area; wherein the apparatus is selectable between a first condition in which the cards are transferable in a first direction from the first arrangement to the second arrangement, and a second condition, in which the cards are transferable in a second direction from the second arrangement to the first arrangement.

The apparatus may include a card value sensor for determining the value of a respective card located in the card playing area.

The apparatus may be arranged such that when in the first condition, the first card storage arrangement is located at a higher position than the position of the second card storage arrangement, and when in the second condition, the second arrangement is located at a higher position than the position of the first arrangement. The apparatus may be configured such that one or more cards can pass from the higher of the card storage arrangements, through the card playing area, and into the lower of the card storage arrangements, under gravity.

The apparatus may be arranged such that when in the first condition, the card playing area is inclined downwardly from the first card storage arrangement to the second card storage arrangement, and when in the second condition, the card playing area is inclined downwardly from the second card storage arrangement to the first card storage arrangement.

Each card storage arrangement may include a generally cylindrical rotatable drum. Each card receiving space may extend radially from a closed inner end to an open end at the circumferential edge of the drum such that a card may be inserted into or removed from the card receiving space.

A housing may be provided around at least part of each drum such that the housing prevents cards entering or leaving one or more card receiving spaces. A slot may be provided in the housing of a size and shape such that a card may be inserted into or removed through the slot from a respective card receiving space aligned therewith.

The apparatus may include drive means to selectively rotate the drums. The drive means may comprise a motor for each drum, and may comprise a gearbox for each drum. The motor may be a step motor.

The apparatus may further comprise brakes for selectively preventing rotation of the drums. The apparatus may further comprise drum position sensors for sensing alignment of a respective card receiving space with the slot, which drum position sensors may comprise a plurality of barcodes and barcode readers.

The apparatus may include a switching arrangement for selectively changing the relative heights of the first and second card storage arrangements between the first and second conditions and for moving the card playing area between respective inclinations.

The switching arrangement may be arranged such that when in the first or second condition, the card playing area has an inclination of between 30° and 90° from the horizontal, and more preferably between 45° and 75° from the horizontal, and preferably at substantially 60° from the horizontal. It has been found that at this inclination cards can move by gravity under control through the apparatus, while preventing damage to the cards.

The card playing area may include an elongate channel, which extends between the first and second card storage arrangements, along which a card can travel face up or face down.

The channel of the card playing area may be divided into a plurality of playing regions along the length thereof by one or more dividers, and a respective card may be locatable within each region in a face up or face down position.

The channel may include a card moving arrangement, arranged to simultaneously turn a respective card between a face up position and a face down position and move the respective card between one playing region and an adjacent in use lower playing region.

The card moving arrangement may comprise one or more pushers. A pusher may be located in each playing region, which pusher may be moveable from a retracted position beneath the channel to an extended position extending into the channel to engage with a card therein.

Each divider may be configured such that a lower edge of a playing card in the respective playing region engages with the divider to cause the card to pivotally move over the divider, thereby turning the card over as it moves to the next region.

Each divider may project upwardly into the channel, and may include a recess in which an edge of a card may locate.

The channel may include three playing regions arranged along the length of the channel. The channel may comprise an uppermost dealt card value recognition region in which a card can be located face down, a display region adjacent the card value recognition region in which a card 'in play' can be located face up, and a lowermost discard region in which a card can be placed face down.

The apparatus may be arranged such that in the second condition the uppermost dealt card value recognition region of the first condition is now the lowermost discard region, and vice versa.

The apparatus may include two card value sensors, and the card value recognition region and discard regions may each include a card value sensor. Each card value sensor may comprise an optical sensor, and may comprise a barcode reader. Alternatively, each card value sensor may comprise a radiofrequency reader which may sense a signal emitted by a radiofrequency emitter located in a respective card.

The apparatus may further include a card presence sensor, which may be arranged to determine the presence of a card in a respective playing region of the channel, and each region may include a card presence sensor. The or each card presence sensor may comprise a light sensor, or may comprise a radiofrequency sensor arranged to detect a radio signal emitted from a transmitter or transponder located within a respective card.

The apparatus may further comprise a control arrangement to control aspects of the operation of the apparatus, and may include first and second controllers. The first controller may be arranged to control the transfer of the cards between the first and second card storage arrangements.

The first controller may include a first output to control the drum drive means of each card storage arrangement, may include a second output to control the switching arrangement, and may include a third output to control the card turning arrangement.

The first controller may include a first input to receive a signal from the second controller, may include a second input to receive a signal from the or each drum position sensor, may include a third input to receive a signal from the or each card presence sensor, and may include a fourth input to receive a signal from a random number generator, which may comprise a noise diode.

The second controller may include a first input to receive a signal from the or each card value sensor, and may include a second input to receive a signal from one or more players' terminals.

The second controller may include a first output to transmit card value information from the or each card value sensor to one or more players' terminals.

The second controller may include a second output to transmit a command to the first controller to transfer a card between the first and second arrangements in response to a command from one or more players' terminals and bring a new card into play.

The apparatus may be arranged such that the or each players' terminal displays a hand of cards for a respective player. Each player's hand of cards may be determined by the cards transferred between the card storage arrangements according to information provided by the control arrangement.

The apparatus may be arranged such that, as the cards are transferred between the first and second arrangements, the card order is shuffled.

The apparatus may include a random number arrangement configured so that the lowermost card storage arrangement is moved, such that each playing card received from the card playing area is received in a randomly selected card receiving space, to shuffle the cards entering the lowermost card storage arrangement.

According to a second aspect of the present invention, there is provided an apparatus for playing a card game, the apparatus including an apparatus according to any of the preceding twenty eight paragraphs, and further comprising at least one player's terminal.

According to a third aspect of the present invention, there is provided a method of use of an apparatus according to any of the preceding twenty nine paragraphs, the method comprising:

selecting a first condition of the apparatus;

consecutively transferring cards in a first direction from selected card receiving spaces in the first arrangement to selected card receiving spaces in the second arrangement via the card playing area;

subsequently selecting a second condition of the apparatus;

consecutively transferring cards in a second direction from selected card receiving spaces in the second arrangement to selected card receiving spaces in the first arrangement.

When in the first condition, each consecutive card may be selected from the first arrangement from adjacent card receiving spaces, and may be transferred to a card receiving space in the second arrangement determined by a random number generator, such that the card order in the second card storage arrangement is shuffled.

When in the second condition, each consecutive card may be selected from the second arrangement from adjacent card receiving spaces, and may be transferred to a card receiving space in the first arrangement determined by a random number generator, such that the card order in the first card storage arrangement is shuffled.

The second condition may be selected once either all of the card receiving spaces of the first arrangement are either empty or the first arrangement contains a minimum number of cards, and the first condition may be selected once either all the card receiving spaces of the second arrangement are empty or the second arrangement contains a minimum number of cards.

The apparatus may automatically move between the first and second conditions.

The value of the cards being transferred may be determined by the card value sensor.

The value of each card determined by the card value sensor may be transmitted to one or more electronic terminals, and a further card may only be transferred when a signal is transmitted from an electronic terminal to the controller.

The value of each card may only be read when a command is given from a players' terminal to transfer a card.

DETAILED DESCRIPTION OF THE INVENTION

FIGS. 1 to 7 of the drawings show a gaming apparatus 100 in accordance with the invention comprising a first apparatus for handling playing cards, which apparatus 100 is selectively moveable between a first condition and a second condition. The apparatus 100 includes first and second card storage arrangements each comprising a respective generally cylindrical drum 1*a*, 1*b*. The apparatus 100 further includes a card playing area in the form of a feeding arrangement comprising a channel 4 extending between the drums 1*a*, 1*b*, along which cards can be transferred therebetween.

Each drum 1*a*, 1*b* can store a plurality of playing cards 7, each card 7 being receivable within a discrete card receiving space 6*a*, 6*b* defined by a plurality of upper and lower radially extending partitions 11*a*, 11*b*.

Figure 2:
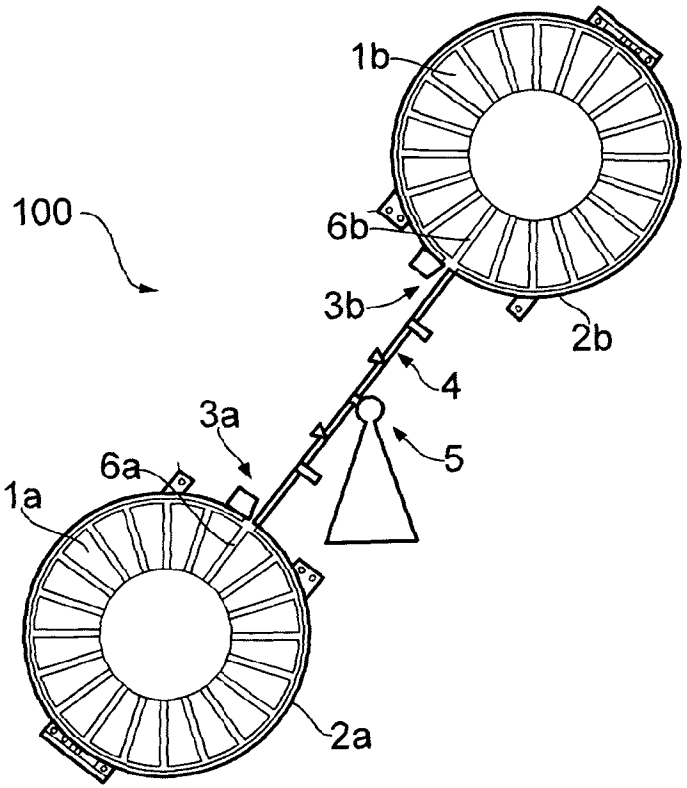
FIG. 2 is a similar view to FIG. 1 but in a second condition.
Figure 1:
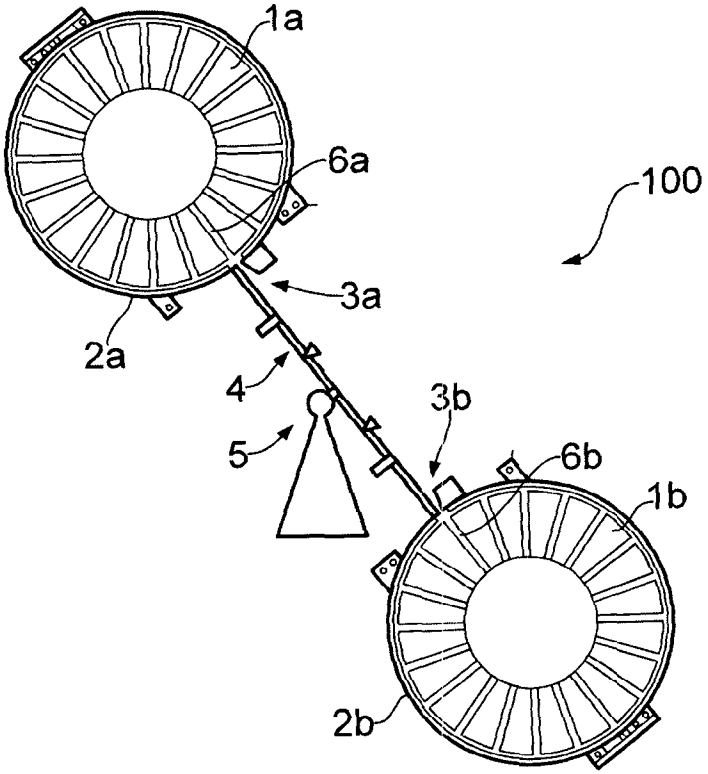
FIG. 1 is a diagrammatic side view of a first apparatus in accordance with the invention in a first condition.

In the first condition as shown in FIG. 1, the first drum 1*a* is positioned higher than the second drum 1*b*, and acts as a supply arrangement to supply cards to the lower second drum 1*b*, via the channel 4 which is inclined downwardly towards the second drum 1*b*. In a second condition, as shown in FIG. 2, the second drum 1*b* is higher and acts as a supply arrangement to supply cards to the first, lower drum 1*a*, via the channel 4 which is now downwardly inclined towards the first drum 1*a*.

The apparatus 100 also includes a pair of card value sensors, which in this embodiment, are in the form of optical sensors 19 with a respective one located towards either end of the channel 4. Each optical sensor 19 is suitable for reading the card value of conventional playing cards 7. In an alternative embodiment, each card value sensor may be in the form of a radiofrequency sensor suitable for reading the card value of cards including transponders.

Each card storage arrangement includes a housing 2*a*, 2*b*, which surrounds part of each respective drum 1*a*, 1*b*. Each housing 2*a*, 2*b* includes an aperture in the form of a slot 3*a*, 3*b* through which a card 7 can pass. Each drum 1*a*, 1*b* can be rotated about its axis relative to the housing 2*a*, 2*b*, so that a respective one of the card receiving spaces 6*a*, 6*b* of each drum 1*a*. 1*b* becomes aligned with the slot 3*a*, 3*b* of the respective housing 2*a*, 2*b*. The drums 1*a*, 1*b* fit within the respective housings 2*a*, 2*b* such that cards 7 can only be removed from the drum 1*a*, 1*b* when a card receiving space 6*a*, 6*b* is aligned with the respective slot 3*a*, 3*b*.

Figure 4:
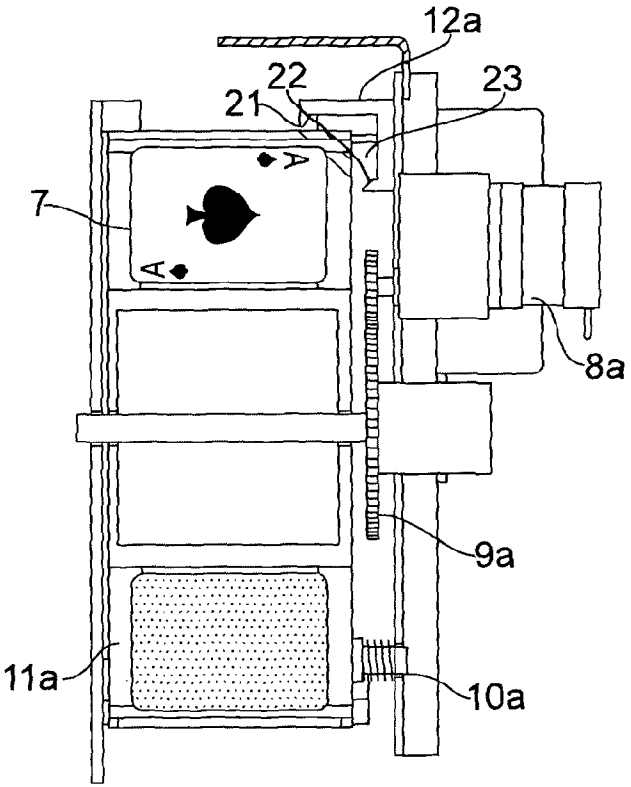
FIG. 4 is a diagrammatic cross sectional front view of the part of the apparatus of FIG. 3.
Figure 3:
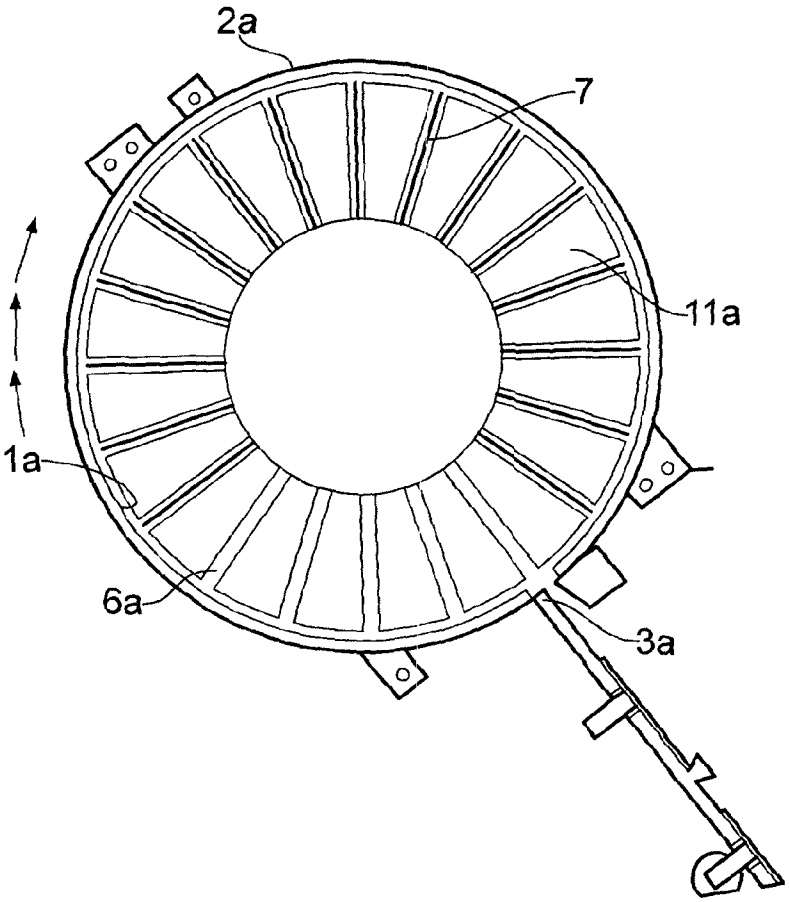
FIG. 3 is a diagrammatic cross sectional side view of part of the apparatus of FIG. 1

FIGS. 3 and 4 show diagrammatic front and cross sectional views of one of the drums 1*a*, with the housing 2*a*, in more detail. In this embodiment, the drum 1*a*, includes 312 playing card receiving spaces 6*a*, such that each arrangement can hold six decks of cards, though fewer card receiving spaces 6*a* are shown in FIGS. 3 and 4 to aid clarity. Each card receiving space 6*a*, is arranged to hold one card 7 only. Each card receiving space 6*a*, is dimensioned such that a respective card 7 can be stored with its longest dimension extending parallel to the axis of the drum 1*a*. This thereby reduces the circumference of the drum 1*a*, 1*b*, in turn reducing the weight of the drum 1*a*, and resulting in a more compact apparatus.

Each card receiving arrangement includes drive means in the form of a step motor 8*a*, 8*b* for rotating the respective drum 1*a*, 1*b*. Each step motor 8*a*, 8*b* is operably connected to the respective drum 1*a*, 1*b* by a corresponding respective gearbox 9*a*, 9*b*. Each card receiving arrangement also includes a respective brake 10*a*, 10*b*. Each brake 10*a*, 10*b* is selectively engageable with a respective drum 1*a*, 1*b* to prevent the drum 1*a*, 1*b* from continuing to rotate after the motor 8*a*, 8*b* is switched off. Each aperture 22 may include an individual barcode, and each drum 1*a*, 1*b* may include a barcode reader. This thereby facilitates exact alignment of the card receiving spaces 6*a*, 6*b* with the slots 3*a*, 3*b*.

Each card receiving arrangement also includes a drum position sensor 12*a*, 12*b* comprising for example a laser emitter 21, a plurality of apertures 22 in the respective drum 1*a*, 1*b* and a laser receiver 23 for sensing the alignment of a card receiving space 6*a*, 6*b* with the slots 3*a*, 3*b*.

Figure 6:
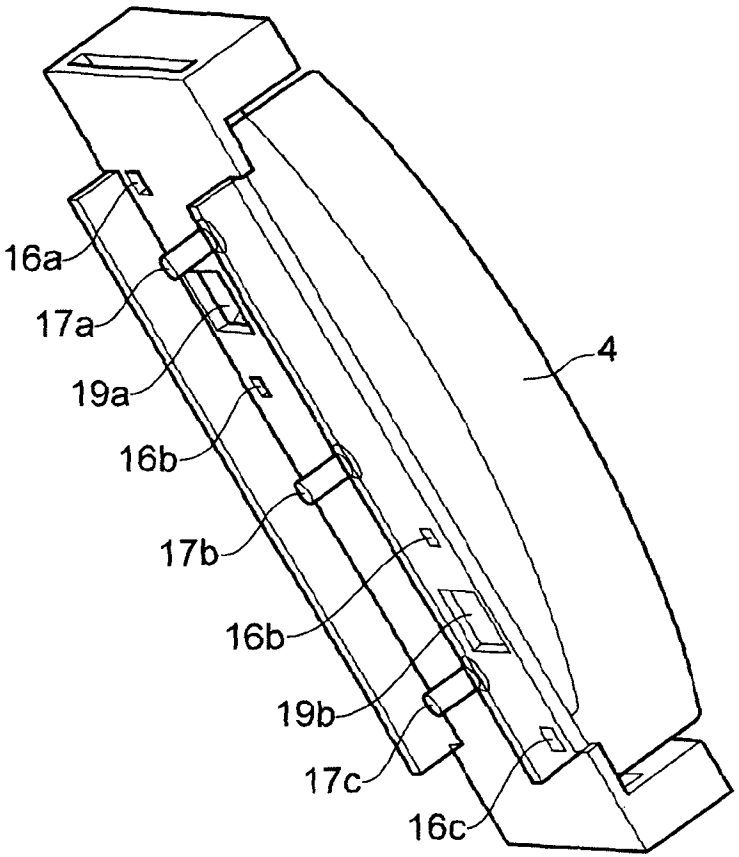
FIG. 6 is a diagrammatic perspective view from beneath of the further part of the apparatus FIG. 5.
Figure 5:
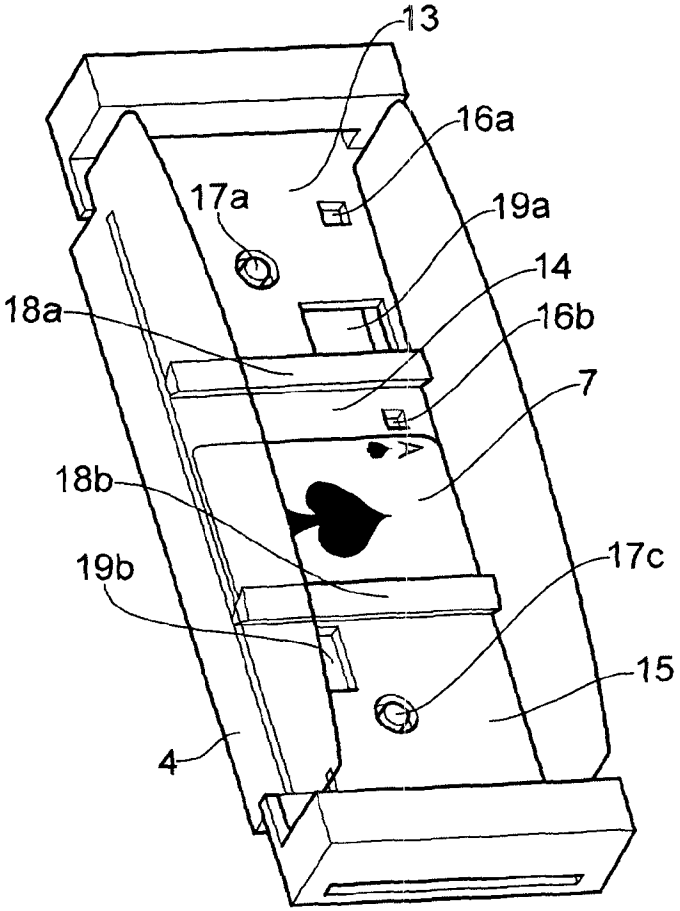
FIG. 5 is a diagrammatic perspective plan view of a further part of the apparatus of FIG. 1.

FIGS. 5 and 6 show the channel 4 in further detail in the first condition. In the first condition, the apparatus 100 will be inclined downwardly from left to right as shown in FIGS. 5 and 6. The channel 4 includes a generally planar base, and upwardly extending side edge parts 20 to guide cards along the channel 4.

The channel 4 is of a width such that playing cards 7 can slidingly fit within the channel 4 with their longest dimension extending transversely, but are prevented from rotating.

The channel 4 comprises three regions 13, 14 and 15 along the length thereof. An uppermost region 13 is a dealt card value recognition region in which a card 7 received from the drum 1*a*, can be located face down. The next region 14 is a card 7 in play display region in which a card 7 can be located face up and viewed by players. A lowermost region 15 is a discard region in which a card 7 can be located face down before transferring into the drum 1*b*.

Each of the channel regions 13, 14 and 15 include a respective card presence sensor 16*a*, 16*b*, 16*c* for detecting the presence of a card 7 in the respective region 13, 14, 15. Each channel region 13, 14, 15 also includes a card turning arrangement comprising a respective pusher 17*a*, 17*b*, 17*c* for turning cards 7 over between a face up position and a face down position or vice versa, whilst the respective card 7 simultaneously moves to a lower adjacent region.

The operation of the pushers 17*a*, 17*b*, 17*c* is described in further detail below. In FIG. 3*a* a usual operation is shown with a face down "dealt" card 7 in region 13, and an "in play" card 7 face up in region 14. Regions 13 and 15 also include card value sensors 19*a*, 19*b* for sensing the card value of a card 7 located face down in the respective region 13, 15.

Dividers 18*a*, 18*b* are provided extending across the channel 4 respectively between the regions 13 and 14, and the regions 14 and 15. The dividers 18*a*, 18*b* prevent the cards from moving linearly therepast along the channel 4 unless the respective pushers 17*a*, 17*b*, 17*c* are actuated from a retracted to an extended position, as described in further detail below. Each divider 18*a*, 18*b* projects from a base of the channel 4, and has a cross section which diverges upwardly and outwardly from the base to define a recess 25 extending along each side edge thereof.

In use, a card 7 rests on its longest edge against a respective divider 18*a*, 18*b*. When a respective pusher 17*a*, 17*b*, 17*c* is activated, the card 7 is pivoted upwardly such that when the centre of gravity of the card 7 is above the respective divider 18*a*, 18*b*, the card turns over whilst simultaneously moving past the respective divider 18*a*, 18*b*.

A switching arrangement 5 is provided to selectively change the relative heights of the first and second card storage arrangements between the first and second conditions and for moving the channel 4 between a first position in which the channel 4 is inclined downwardly from the first card holding arrangement to the second card holding arrangement, and vice versa.

The switching arrangement 5 is arranged to pivot the channel 4 and each card storage arrangement about an axis extending perpendicularly to the channel 4. When the apparatus 100 is in the first or second condition, the plane of the channel 4 has an inclination of between 45° and 75° and in this instance around 60° from the horizontal. The switching arrangement could comprise a further step motor (not shown).

Figure 7:
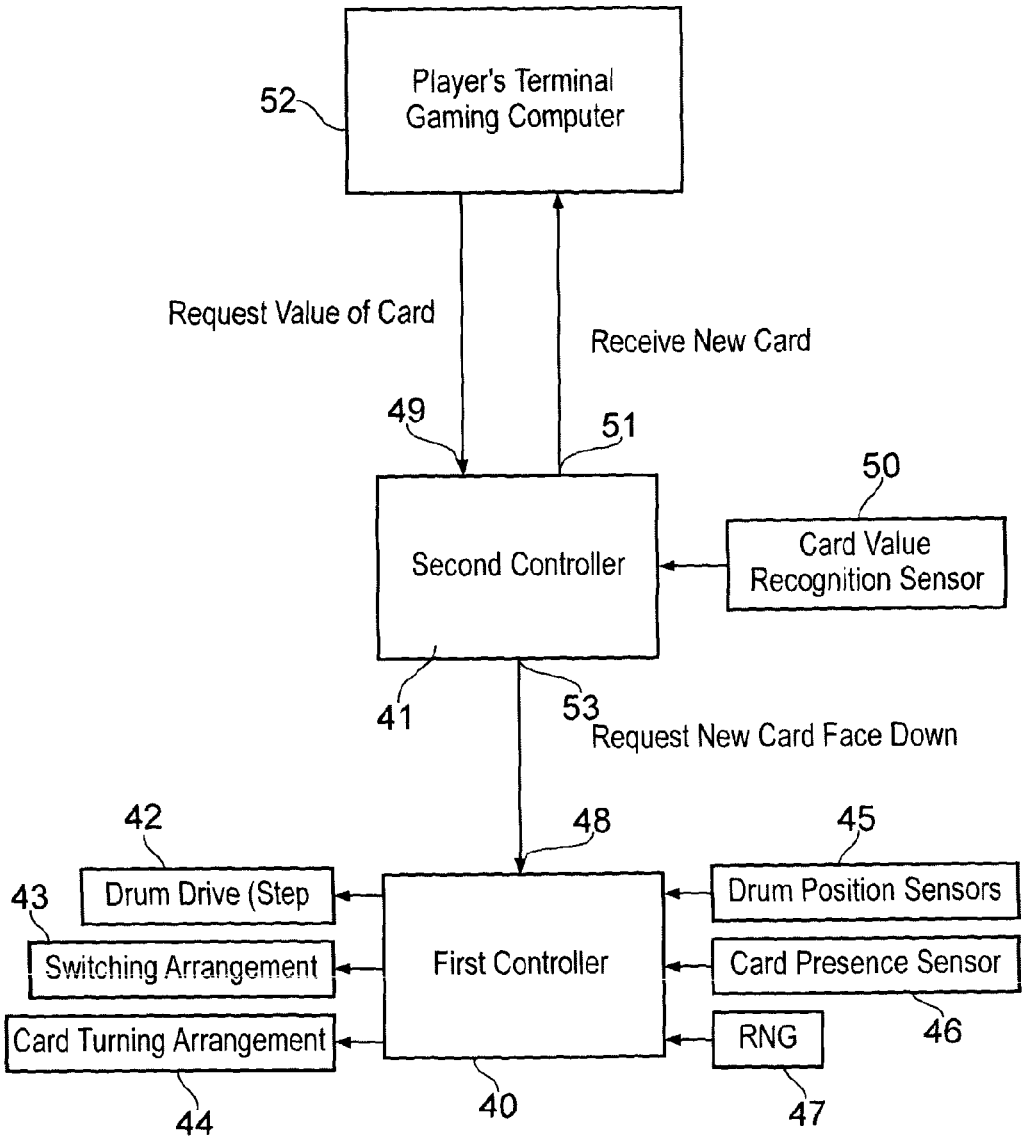
FIG. 7 is a block diagram showing connections between the elements of the apparatus of FIG. 1.

The apparatus 100 further includes one or more players' terminals 52 and a control arrangement comprising first and second controllers 40, 41, as diagrammatically shown in FIG. 7.

The first controller 40 includes: a first output 42 to control the drum drive means (step motors 8*a*, 8*b*) of each card storage arrangement; a second output 43 to control the switching arrangement 5; and a third output 44 to control the pushers 17*a*, 17*b*, 17*c*. The first controller 40 also includes: a first input 48 to receive a signal from the second controller 41; a second input 45 to receive a signal from each drum position sensor 12*a*, 12*b*; a third input 46 to receive a signal from each card presence sensor 16*a*, 16*b*, 16*c*; and a fourth input 47 to receive a signal from a random number generator in the form of a noise diode 47.

The second controller 41 includes a first input 49 to receive a signal from each card value sensor 19*a*, 19*b*, and a second input 50 to receive a signal from one or more players' terminals 52. The second controller 41 further includes a first output 51 to transmit card value information from each card value sensor 19*a*, 19*b* to one or more players' terminals 52. The second controller 41 also includes a second output 53 to transmit a command to the first controller 40 to transfer a card 7 between the first and second arrangements in response to a command from one or more players' terminals 52 and bring a new card 7 into play.

The provision of two separate controllers 40, 41 ensures that the system facilitates security of handling cards 7 in the game. The first controller 40 which shuffles and moves cards 7 does not contain information regarding the value of the cards 7, while the second controller 41 which recognises card values and transmits them to the gaming computer 52, does not participate in shuffling and moving the cards 7.

The apparatus 100 can operate as follows. The first arrangement is loaded with cards 7 as necessary in the card receiving spaces 6*a* of the drum 1*a*. If necessary the controller operates the switching arrangement 5 to pivot the channel 4 and the first and second arrangements to the first condition, with the first arrangement being located higher than the second arrangement, and the channel 4 being inclined downwardly from the first arrangement to the second arrangement at an angle of around 60° from the horizontal. It has been found that at this inclination cards 7 can readily move by gravity under control through the apparatus 100.

Once the apparatus 100 is in the first condition, the first controller 40 activates the step motor 8*a* associated with the first drum 1*a*, thereby turning the first drum 1*a* to align a first card receiving space 6*a* with the slot 3*a*. The card 7 located within the first card receiving space 6*a* will then slide out of the first card receiving space 6*a* under gravity onto the card recognition channel region 13 in a face down position, to provide a face down 'dealt' card 7.

A player may then use a respective terminal 52 to request a card 7. Once this request is made, the card value sensor 19 associated with the card recognition channel region 13 is activated, and senses the value of the card 7 thereon. The card value is sent to the second controller 41, and from there to the respective players' terminal 52.

The first controller 40 then actuates the pusher 17*a* associated with the card value recognition channel region 13 from a retracted position to an extended position. The lower edge of the card 7 is engaged within the recess 25 of the divider 18*a* located between channel regions 13 and 14. The pusher 17*a* engages against a lower face of the card 7 spaced from the lower edge thereof, to pivot the card upwardly about the lower edge, until the card is pivoted past its centre of gravity. The card 7 then simultaneously turns over and moves into the adjacent channel region 14 in a face up position.

The card 7 is now located face up in the display channel region 14, where the players either at the table or at their respective terminals 52 can view the card 24.

A signal is then sent from the card presence sensor 16*a* associated with the channel region 13 that a card 7 is no longer present in the channel region 13. The first controller 40 then actuates the motor 8*a* associated with the first drum 1*a* to rotate the drum 1*a* such that the adjacent card receiving space is aligned with the slot 3*a*. The card 7 in said adjacent space will then slide into the region 13 in a similar manner.

The first controller then actuates the motor 8*b* associated with the second drum 1*b* to randomly align the a card receiving space of the second card storage arrangement with the slot 3*b* of the housing 2*b*. The random card receiving space is determined by a signal transmitted by the noise diode to the first controller 40.

A player may then request a further card 7, whereupon a signal is sent from the respective players' terminal 52 to the second controller 41, which sends a command to the first controller 40 to actuate the pusher 17*b* associated with the second channel region 14 from a retracted position to an extended position to move the card 7 to the adjacent discard channel region 15, whilst simultaneously causing it to turn over to a face down position in a similar manner to that described above. The card 7 will then slide into the respective randomly selected empty card receiving space 6*b* of the second drum 1*b*.

Once the card presence sensor 16*b* associated with the channel region 15 has sent a signal to the first controller 40 to indicate that the card 7 has entered into the random card receiving space in the second drum 1*b*, the card 7 in the region 13 can be moved and turned over as described above into the region 14. A further card 7 can also then be supplied into the region 13.

The above steps are repeated until the either the first drum 1*a* is empty or reaches a specified minimum number of cards, or the second drum 1*b* is full. Once one of these conditions is satisfied, the first controller 40 actuates the switching arrangement 5 to pivot the channel 4 to the second condition.

The channel region 15 of the first condition then becomes the card value recognition region 13 in the second condition, and the channel region 13 of the first condition becomes the discard region 15 in the second condition. Cards 7 can then be transferred from the second drum 1*b* to the first drum 1*a* in a similar reverse manner.

The apparatus and method of use of the present invention provide a means for fully automatically dealing and shuffling cards within a closed system, in which cards are continually transferred between the arrangements without dealer intervention, thereby removing the need for the dealer's service at the table as well as reducing the need for inspection personnel. The apparatus has been found to be reliable and secure.

The cards are kept separate from each other at all times, which prevents damage to the cards and requires less service to the system and reduced card waste. The card values are not known by the system until a further card is requested by a player, which ensures security and complies with requirements of the leading gaming regulation bodies.

Figure 8:
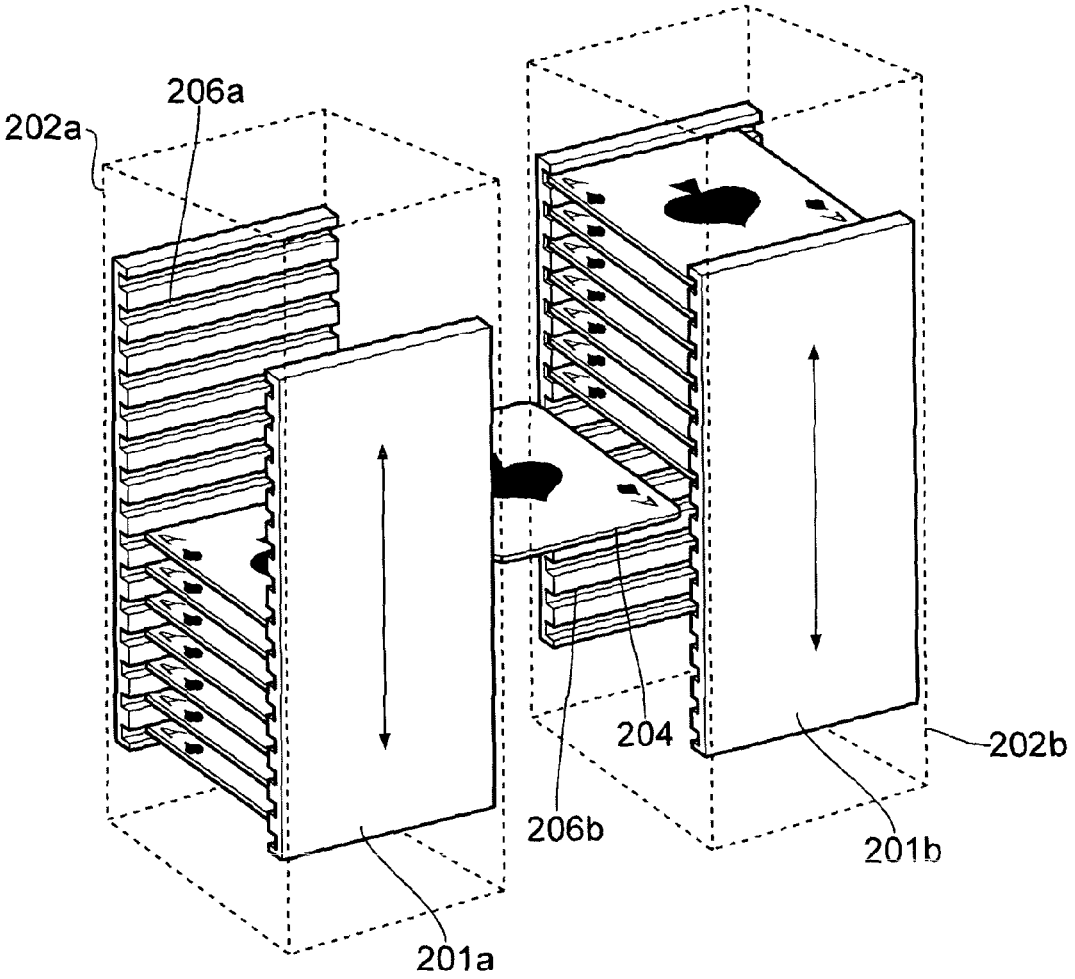
FIG. 8 is a diagrammatic side view of a second apparatus in accordance with the invention.

FIG. 8 shows a second apparatus 200 in accordance with the invention in a first condition. The parts and operation of the second apparatus 200 are similar to those of the first apparatus 100 except for the following aspects.

The apparatus 200 includes a pair of rectangular containers 201*a*, 201*b* located within a respective housing 202*a*, 202*b* and connected by a channel 204, which channel 204 is similar to the channel 4. Each rectangular container 201*a*, 201*b* includes a plurality of card receiving spaces 206*a*, 206*b* stacked one on top of another. Each container 201*a*, 201*b* is arranged to be moveable vertically within the housing in either direction to align or misalign a respective card receiving space 206*a*, 206*b* of a respective container 201*a*, 201*b* with a slot 203*a*, 203*b* of a respective housing to allow a card 7 to be inserted or removed therefrom. The apparatus 200 includes a switching arrangement similar to the switching arrangement 5 such that the apparatus 200 can be pivoted about the channel 204 to move the apparatus between first and second conditions.

The apparatus 200 is controlled by a control arrangement comprising first and second controllers similar to the controllers 40, 41.

In use, in the first condition, the first container 201*a* can be moved to sequentially align adjacent card receiving spaces with the slot 203*a* such that cards 7 are slid out of respective card receiving spaces, and moved along the channel 204 by the control arrangement in a similar manner to that described above in relation to the first apparatus 100. The second container 201*b* can be moved to align random card receiving spaces to accept cards from the channel 4.

In the second condition, the first container 201*a* is moved sequentially and the second container 201*b* is moved randomly, as in the first apparatus 100.

Various other modifications may be made without departing from the scope of the invention. For instance, different sized drums could be used for storing different amounts of cards.

Different types of card value sensors could be used, such as bar code readers for reading a bar code imprinted on the card, or a radiofrequency reader which could sense a signal emitted by a radiofrequency emitter located in a respective card. The channel may be positioned at different angles, and may be positioned vertically in some cases. Different means could be used to turn the cards over.

Whilst endeavouring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

The invention claimed is:

1. An apparatus for a card game using physical playing cards, the apparatus comprising:

first and second card storage arrangements for storing a plurality of cards, each arrangement having a plurality of card receiving spaces, each card receiving space being arranged to store a respective single card;

a card feeding arrangement for consecutively transferring cards from a selected card receiving space in one of the first and second arrangements to a selected card receiving space in the other of the first and second arrangements via a card playing area; wherein the apparatus is selectable between a first condition in which the cards are transferable in a first direction from the first arrangement to the second arrangement, and a second condition, in which the cards are transferable in a second direction from the second arrangement to the first arrangement.

2. An apparatus according to claim 1, in which the apparatus includes a card value sensor for determining the value of a respective card located in the card playing area.

3. An apparatus according to claim 1, in which the apparatus is arranged such that when in the first condition, the first card storage arrangement is located at a higher position than the position of the second card storage arrangement, and when in the second condition, the second arrangement is located at a higher position than the position of the first arrangement, the apparatus being configured such that one or more cards can pass from the higher of the card storage arrangements, through the card playing area, and into the lower of the card storage arrangements, under gravity.

4. An apparatus according to claim 3, in which the apparatus is arranged such that when in the first condition, the card playing area is inclined downwardly from the first card storage arrangement to the second card storage arrangement, and when in the second condition, the card playing area is inclined downwardly from the second card storage arrangement to the first card storage arrangement.

5. An apparatus according to claim 3, in which the apparatus includes a switching arrangement for selectively changing the relative heights of the first and second card storage arrangements between the first and second conditions and for moving the card playing area between respective inclinations.

6. An apparatus according to claim 3, in which the channel includes three playing regions arranged along the length of the channel, and comprises an uppermost dealt card value recognition region in which a card can be located face down, a display region adjacent the card value recognition region in which a card 'in play' can be located face up, and a lowermost discard region in which a card can be placed face down.

7. An apparatus according to claim 1, in which each card storage arrangement includes a generally cylindrical rotatable drum.

8. An apparatus according to claim 7, in which each card receiving space extends radially from a closed inner end to an open end at the circumferential edge of the drum such that a card may be inserted into or removed from the card receiving space.

9. An apparatus according to claim 7, in which a housing is provided around at least part of each drum such that the housing prevents cards entering or leaving one or more card receiving spaces.

10. An apparatus according to claim 9, in which a slot is provided in the housing of a size and shape such that a card may be inserted into or removed through the slot from a respective card receiving space aligned therewith.

11. An apparatus according to claim 10, in which the apparatus further comprises drum position sensors for sensing alignment of a respective card receiving space with the slot, the drum position sensors comprising a plurality of barcodes and barcode readers.

12. An apparatus according to claim 1, in which the card playing area includes an elongate channel, which extends between the first and second card storage arrangements, along which a card can travel face up or face down.

13. An apparatus according to claim 12, in which the channel of the card playing area is divided into a plurality of playing regions along the length thereof by one or more dividers, a respective card is locatable within each region in a face up or face down position, and the channel includes a card moving arrangement, arranged to simultaneously turn a respective card between a face up position and a face down position and move the respective card between one playing region and an adjacent in use lower playing region.

14. An apparatus according to claim 1, in which the apparatus comprises a control arrangement to control aspects of the operation of the apparatus, the apparatus includes first and second controllers, the first controller is arranged to control the transfer of the cards between the first and second card storage arrangements, and the first controller includes an input to receive a signal from a random number generator.

15. An apparatus according to claim 14, in which the second controller includes an input to receive a signal from one or more players' terminals, and a first output to transmit card value information from the or each card value sensor to one or more players' terminals.

* * * * *